US011903494B2

(12) United States Patent
Hargreaves et al.

(10) Patent No.: US 11,903,494 B2
(45) Date of Patent: Feb. 20, 2024

(54) BEDS FOR CHILDREN

(71) Applicant: Mamas & Papas Limited, Huddersfield (GB)

(72) Inventors: Nichola Leanne Hargreaves, Huddersfield (GB); Matthew Harris, Huddersfield (GB)

(73) Assignee: Mamas & Papas Limited, Huddersfield (GB)

( * ) Notice: Subject to any disclaimer, the term of this patent is extended or adjusted under 35 U.S.C. 154(b) by 0 days.

(21) Appl. No.: 17/348,009

(22) Filed: Jun. 15, 2021

(65) Prior Publication Data

US 2021/0393048 A1 Dec. 23, 2021

(30) Foreign Application Priority Data

Jun. 23, 2020 (GB) ..... 2009587

(51) Int. Cl.
*A47D 7/02* (2006.01)
*A47D 9/00* (2006.01)

(52) U.S. Cl.
CPC ..... *A47D 7/02* (2013.01); *A47D 9/00* (2013.01); *A47D 9/012* (2022.08)

(58) Field of Classification Search
CPC ..... A47D 9/00; A47D 7/02
See application file for complete search history.

(56) References Cited

U.S. PATENT DOCUMENTS 4,703,524 A 11/1987 Brunner et al.
2002/0002741 A1* 1/2002 Tomas ..... A47D 13/107 5/101
2017/0238721 A1* 8/2017 Damiani ..... A47D 7/02
2019/0099012 A1 4/2019 Zhang et al.

FOREIGN PATENT DOCUMENTS

EP 3207831 A1 8/2017
GB 2472853 A 2/2011
WO 2016172733 A1 10/2016

OTHER PUBLICATIONS

European extended search report, Application No. 21179807.9, dated Nov. 17, 2021.
Combined Search and Examination Report under Sections 17 and 18(3), Application No. GB2009587.3, dated Dec. 14, 2020.

* cited by examiner

*Primary Examiner* — Justin C Mikowski
*Assistant Examiner* — Adam C Ortiz
(74) *Attorney, Agent, or Firm* — MacMillan, Sobanski & Todd, LLC

(57) ABSTRACT

A bed includes a base, an upper frame, and a plurality of walls extending upwardly from the base to the upper frame. One of the frame members is a movable frame member that is movable relative to another of the frame members in order to adjust a height of a portion of the rim formed by the movable frame member relative to the base. The upper frame is configured such that the movable frame member is movable between first, second, and third predetermined positions relative to the base. The upper frame includes a locking mechanism configured to selectively lock the movable frame member at the first and second predetermined positions. The upper frame is configured such that the position of the movable frame member is biased to move from the third predetermined position toward the first and second predetermined positions.

23 Claims, 10 Drawing Sheets

BEDS FOR CHILDREN

BACKGROUND OF THE INVENTION

The present disclosure relates to beds for children and is particularly, although not exclusively, concerned with a bedside crib that improves the ease with which a child can be placed into the crib.

Parents of young children, e.g., infants, particularly those who are feeding or regularly checking on their child during the night, often put their child to sleep in a child's bed, e.g., a cot or crib, placed alongside the parent's bed. Beds for young children often include vertical walls extending around a perimeter of a mattress base of the bed, which enclose an interior space of the bed and prevent the child from falling out of the bed. However, in order to improve the ease with which the child can be placed into and brought out of the bed, a part of the wall of the bed may be removable. In particular, a part of the wall of the bed extending along a side of the mattress base that is arranged to abut the parent's bed may be removable. In this way, when a parent is on the parent's bed, the parent can to move the child toward them and out of the child's bed without lifting the child over the wall of the child's bed.

When a part of the wall of the child's bed has a height above the top of the mattress that is less than a predetermined height, for example, when the wall has been removed, it is desirable for the child's bed to be attached to the parent's bed. This may ensure that a gap cannot form between the child's bed and the parent's bed adjacent to the side of the child's bed adjacent to where the wall has been removed.

Accordingly, when the child's bed is not to be attached to the parent's bed, e.g., because the child's bed cannot fit into the available space adjacent to the parent's bed, it may be undesirable for the part of the wall of the child's bed to be removed. In such situations, it may be necessary for the child to be lifted over the wall of the child's bed to place the child into and move the child out of the child's bed.

SUMMARY OF THE INVENTION

According to an aspect of the present disclosure, there is provided a bed for a child, the bed including: a base forming a surface for the child to be laid on; an upper frame including two or more frame members at least partially forming a rim around an opening into an interior space of the bed, e.g., to receive the child; and a plurality of walls extending upwardly from the base to the upper frame, the plurality of walls extending around the surface to partially enclose the interior space of the bed, wherein one of the frame members is a movable frame member, wherein the movable frame member is movable relative to another of the frame members in order to adjust a height of a portion of the rim formed by the movable frame member relative to the base, wherein the upper frame is configured such that the 11.11 movable frame member is movable between first, second, and third predetermined positions at which the height of the portion of the rim is at first, second, and third respective predetermined heights relative to the base, wherein the upper frame includes a locking mechanism configured to selectively lock the movable frame member at the first and second predetermined positions, and wherein the upper frame is configured such that the position of the movable frame member is biased to move from the third predetermined position toward the first and second predetermined positions.

Because the movable frame member is biased to move from the third predetermined position toward the first and second predetermined positions, the movable frame member can be safely moved to the third predetermined position to improve the ease with which a child can be moved into or out of the bed, without the bed being attached to a parent's bed.

The opening may be in a horizontal plane, e.g., such that a child may be moved through the opening in a vertical direction.

The third predetermined height may be less than the first and second predetermined heights. The second predetermined height may be less than the first predetermined height. For example, the first predetermined height may be approximately 300 mm. The second predetermined height may be approximately 200 mm, and the third predetermined height may be less than 200 mm, such as approximately 120 mm.

The upper frame may be configured such that the movable frame member is biased to move from the third predetermined position past the second predetermined position to the first predetermined position, e.g., when allowed to move freely.

The upper frame may have a first mode of operation. In the first mode of operation of the upper frame, the locking mechanism may be configured to lock the position of the movable frame member at the second predetermined position, e.g., when the movable frame member is at the second predetermined position. In the first mode of operation, the locking mechanism may be configured to lock the position of the movable frame member at the first predetermined position when the movable frame member is at the first predetermined position.

The upper frame may have a second mode of operation. In the second mode of operation of the upper frame, the locking mechanism may be configured such that the movable frame member does not become locked in the first or second predetermined positions.

The movable frame member may form a portion of the rim extending between a head end of the bed and a foot end of the bed.

The upper frame may include an actuator configured to selectively actuate the locking mechanism between a locking configuration, in which the locking mechanism may be to lock the position of the movable frame member at the first or second predetermined height, and an unlocked configuration, in which the movable frame member may not become locked in the first or second predetermined positions. The locking mechanism and/or the actuator may be biased into the locking configuration. For example, the locking mechanism and/or the actuator may include one or more biasing members, e.g., resilient members, such as coil springs, configured to bias the locking mechanism and/or the actuator into the locking configuration. The locking mechanism may be thereby configured to lock the position of the movable frame member at the first or second predetermined positions when the movable frame member is moved to the first or second predetermined positions.

The upper frame may further include a further actuator configured to selectively lock the actuator in the unlocked configuration. The further actuator may be thereby be configured to select the first mode of operation or the second mode of operation of the upper frame.

The locking mechanism may include a fixed portion, e.g., a first hinge component, coupled to a component of the upper frame other than the movable frame member, e.g., a fixed frame member, and a locking portion, e.g., a first locking component. The locking portion may be configured to move together with the movable frame member, e.g., in a first direction and optionally a second direction opposite to the first direction, as the movable frame member moves between the first, second, and third predetermined positions. The locking portion may be movable, e.g., in a third direction, between a locking configuration, in which the locking portion engages the fixed portion to prevent the movable member from moving relative to the other members of the upper frame, and an unlocked configuration, in which the locking portion does not engage the fixed portion. The locking portion may be movable under the action of the actuator.

The locking mechanism may further include a further locking portion, e.g., a second locking component. At least one of the locking portion and the further locking portion may include a ramp surface. The actuator may be configured to selectively move the further locking portion relative to the locking portion between a locking position and an unlocking position of the further locking portion. Movement of the further locking portion from the locking position toward the unlocking position may cause the further locking portion and the locking portion engage at the ramp surface to thereby urge the locking portion in the third direction.

The further locking portion may be movable in the first direction and optionally the second direction, e.g., relative to the locking portion.

The locking mechanism may include a biasing member configured to bias the locking portion and/or the further locking portion such that the locking portion may be moved toward the locking position of the locking portion.

The actuator may be mounted on the movable frame member. The upper frame may include a linkage, such as a pull cable, extending between the actuator and the locking mechanism. The linkage may extend inside a hollow interior of the movable frame member between the actuator and the locking mechanism.

The movable frame member may be pivotally coupled to a further frame member of the upper frame, e.g., the fixed frame member. The movable frame member may be movable between the first, second, and third positions by pivoting the movable frame member relative to the further member. For example, the movable frame member may be pivotable about a first axis of rotation. The first direction may include a clockwise direction about the first axis of rotation and optionally the second direction may include an anticlockwise direction about the first axis of rotation, or vice versa.

The locking mechanism may form a hinge between the movable frame member and the further member. The locking mechanism may include a first hinge member coupled to the further frame member and a second hinge member coupled to the movable frame member. The first hinge member may be pivotally coupled to the second hinge member. The first hinge member may include the fixed portion. The locking portion may be movably coupled to the second hinge member. The further locking portion may be movably, e.g., slidably, mounted on the second hinge member.

To avoid unnecessary duplication of effort and repetition of text in the specification, certain features are described in relation to only one or several aspects or embodiments of the invention. However, it is to be understood that, where it is technically possible, features described in relation to any aspect or embodiment of the invention may also be used with any other aspect or embodiment of the invention.

Various aspects of this invention will become apparent to those skilled in the art from the following detailed description of the preferred embodiment, when read in light of the accompanying drawings.

DETAILED DESCRIPTION OF THE PREFERRED EMBODIMENT

Figure 1:
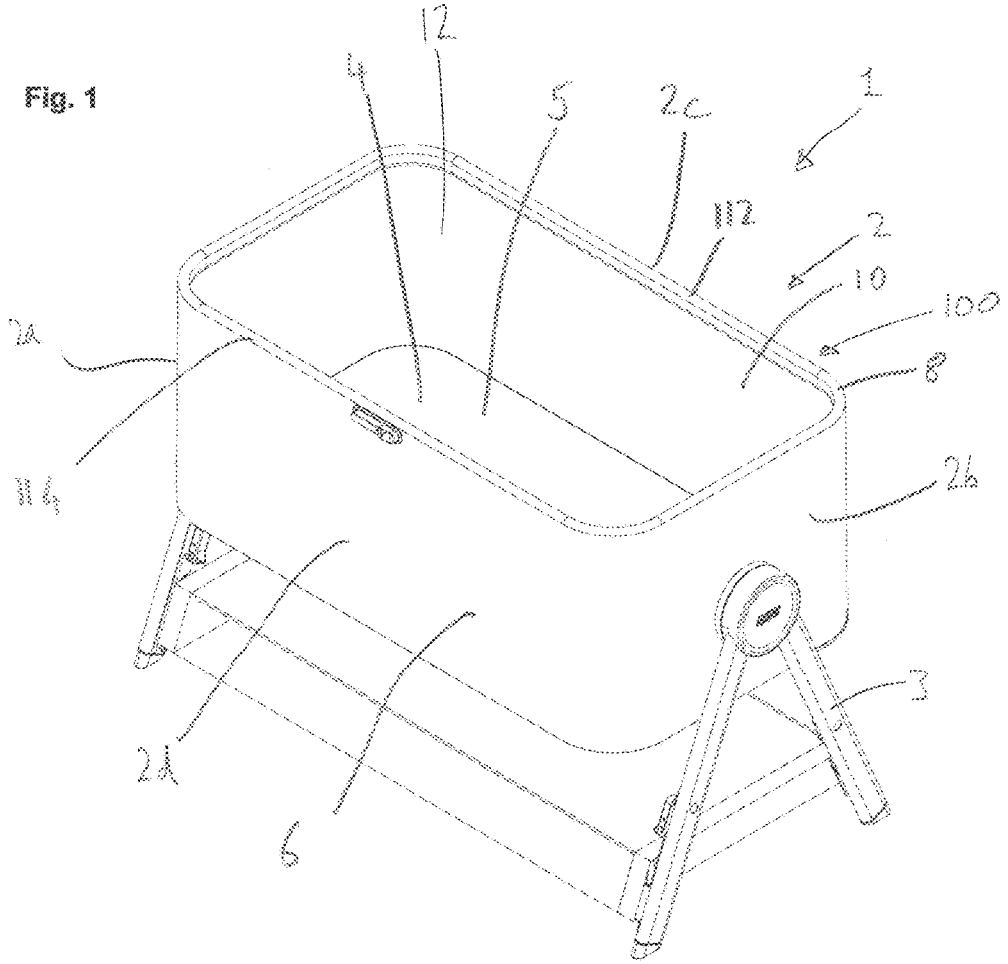
FIG. 1 is a perspective view of a bed for a child according to arrangements of the present disclosure.
Figure 2:
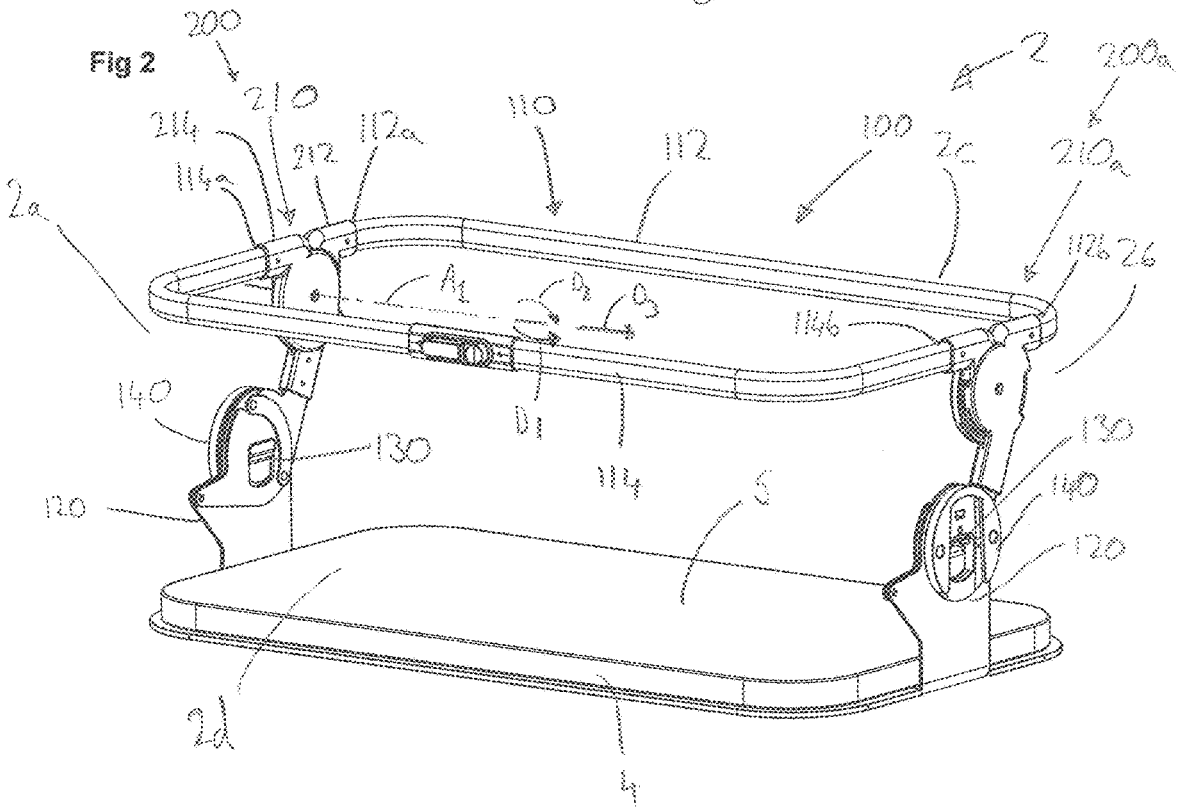
FIG. 2 is a perspective view of a frame of the bed shown in FIG. 1, with a movable frame member of an upper frame of the bed in a first predetermined position.

With reference to FIGS. 1 and 2, a bed assembly 1 includes a bed 2 for a child and a stand 3 for supporting the bed 2. The bed 2 includes first and second longitudinal ends 2*a*, 2*b*, which may be referred to as a head end 2*a* and a foot end 2*b* of the bed, and first and second lateral sides 2*c*, 2*d*.

The bed 2 includes a base 4, a frame 100 including an upper frame 110, and walls 6 extending between the base 4 and frame members 112, 114 of the upper frame 110. In FIG. 2, the walls 6 have been omitted for clarity.

The base 4 forms a surface 5 for the child to be laid on. In one or more arrangements, the base 4 may include a mattress for supporting the child on the base. As depicted in FIGS. 1 and 2, the frame members 112, 114 of the upper frame 110 at least partially form a rim 8 around an opening 10 into an interior space 12 of the bed 2 within which the child is received.

As depicted in FIG. 1, the walls 6 may extend upwardly from the base 4. In particular, the walls 6 may extend between the base 4 and the frame members 112, 114 of the upper frame 110. As depicted, the walls 6 may extend around a perimeter of the surface 5 defined by the base 4 to partially enclose the interior space 12. In other words, the walls 6 may extend along the first and second longitudinal ends 2*a*, 2*b* and the first and second lateral sides 2*c*, 2*d*. The walls 6 may be formed from a flexible material, such as fabric. In some arrangements, at least a portion of the walls 6 may be made from a meshed material which allows a flow of air to pass into the interior space 12 of the bed 2 through the walls 6.

As depicted in FIG. 2, the frame 100 includes the upper frame 110 and one or more structural members 120 for coupling the upper frame 110 to the base 4. In one or more arrangements, the upper frame 110 may be movably, e.g., pivotally, coupled to the structural member 120 to enable the upper frame to move relative to the base, e.g., in order to collapse the bed 2. The frame 100 may include a structure locking mechanism 130 for locking the position of the upper frame 110 relative to the structural members 120.

The frame 100 may further include one or more stand connectors 140 for selectively connecting the bed 2 to the stand 3. As depicted, the stand connectors 140 may be provided on the structural members 120. In other arrangements, the stand connectors 140 may be provided on another component of the frame 100 or bed 2, such as on the base 4. In some arrangements, the base 4 of the bed may be placed directly onto a surface, such as the floor, for supporting the bed. In other words, the stand 3 may be omitted.

The upper frame 110 includes a first frame member 112, a second frame member 114, and a hinge assembly 210. The first and second frame members 112, 114 may be pivotally coupled together at the hinge assembly 210. As depicted in FIG. 2, the hinge assembly 210 may be located at the head end 2*a* of the bed 2 and may be located between the first and second lateral sides 2*c*, 2*d* of the bed, e.g., substantially centrally between the first and second lateral sides.

In some arrangements, the upper frame 110 may include a further hinge assembly 210*a* located at the foot end 2*b* of the bed. The further hinge assembly 210*a* may be located between the first and second lateral sides 2*c*, 2*d* of the bed, e.g., substantially centrally between the first and second lateral sides. The further hinge assembly may be similar to the hinge assembly 210, for example, the further hinge assembly may be a mirror image of the hinge assembly. Hence, the features described in relation to the hinge assembly 210 may apply equally to the further hinge assembly 210*a*.

As shown, the first frame member 112 may extend from a first end 112*a* of the first frame member 112 at the head end 2*a* of the bed to a second end 112*b* of first frame member 112 at the foot end 2*b* of the bed, e.g., along the first lateral side 2*c*. The first frame member 112 may be coupled to the hinge assembly 210 at the first end 112*a* of the first frame member 112 and may be coupled to the further hinge assembly 210*a* at the second end 112*b*. As shown in FIG. 2 the first frame member 112 may extend from the hinge assembly 210 along the head end 2*a* to the first lateral side, along the first lateral side 2*c* to the foot end 2*b* and along the foot end 2*b* to the further hinge assembly 210*a*.

The second frame member 114 may extend from a first end 114*a* of the second frame member 114 at the head end 2*a* of the bed to a second end 114*b* of the second frame member at the foot end 2*b* of the bed, e.g., along the second lateral side 2*d*. The second frame member 114 may be coupled to the hinge assembly 210 at the first end 114*a* of the second frame member and may be coupled to the further hinge assembly 210*a* at the second end 114*b* of the second frame member 114. The second frame member 114 may extend from the hinge assembly 210 along the head end 2*a* to the second lateral side 2*d*, along the second lateral side 2*d* to the foot end 2*b* and along the foot end 2*b* to the further hinge assembly 210.

The first frame member 112 and the second frame member 114 may thereby be arranged to extend about the opening 10 into the interior space 12 of the bed to together form the rim 8 around the opening 10.

The hinge assembly 210 includes a first hinge component 212 and a second hinge component 214. The first and second hinge components 212, 214 are pivotally coupled together to support pivotal movements of the first and second hinge components relative to one another about a first axis $A_1$, e.g., in opposing first and second, e.g., clockwise and anti-clockwise, directions $D_1$, $D_2$ about the first axis $A_1$. The first and second hinge components 212, 214 may be coupled together such that the first and second hinge components are fixed relative to one another in a third direction $D_3$ parallel with the first axis. The first hinge component 212 is coupled to the first frame member 112 and a second hinge component 214 is coupled to the second frame member 114. Each of the frame members 112, 114 may be fixedly coupled to the respective hinge components 212, 214. The first and second frame members are thereby pivotally coupled together by the hinge assembly 210.

As depicted in FIG. 2, the frame 100 may be coupled to the structural member 120 via the first hinge component 212. Hence, the first frame member 112 may be fixed relative to the base 4, e.g., when the structure locking mechanism 130 is locked. The second frame member 114 may be movable, e.g., pivotable, relative to the base 4 by virtue of the hinge assembly 210. In particular, the second frame member 114 may be movable in the first and second directions $D_1$, $D_2$, e.g., about the first axis $A_1$. The first frame member 112 may therefore be referred to as a fixed frame member, and the second frame member 114 may be referred to as a movable frame member.

Figure 3A:
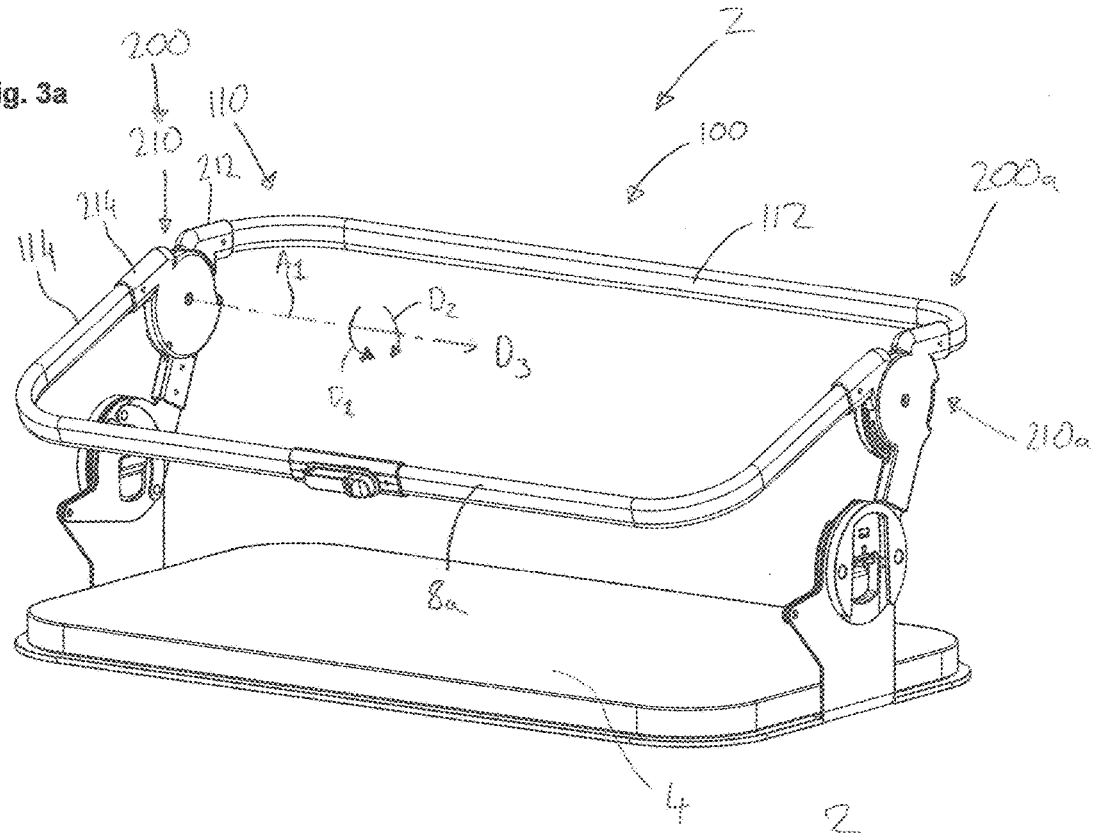
FIGS. 3*a* and 3*b* are perspective views of the frame shown in FIG. 2, with the movable frame member of the upper frame in second and third predetermined positions, respectively.
Figure 3B:
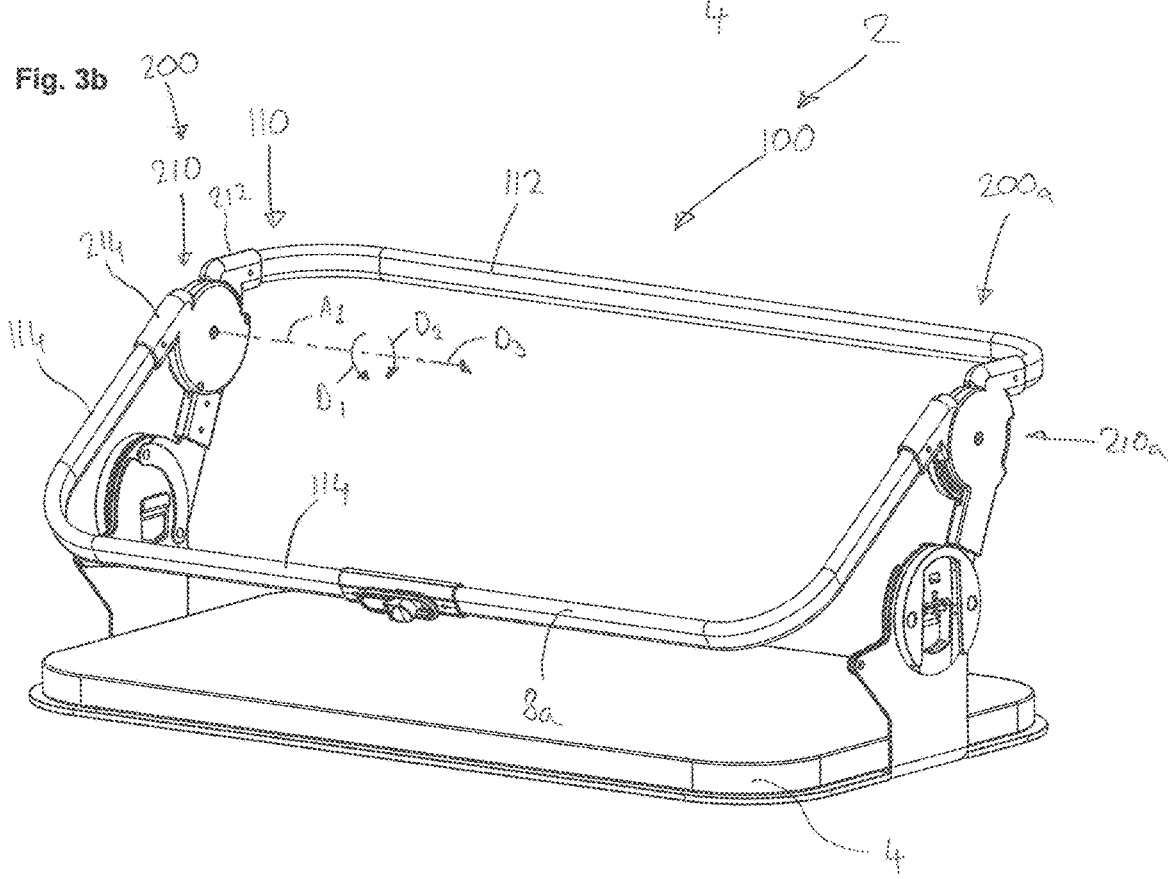

As shown in FIGS. 2, 3*a*, and 3*b*, the bed 2, e.g., the upper frame 110 of the bed may be configured such that the movable frame member 114 is movable between first, second, and third predetermined positions (illustrated in FIGS. 2, 3*a*, and 3*b* respectively), at which a portion 8*a* of the rim formed by the movable frame member 114 is at first, second, and third respective predetermined heights relative to the base 4 of the bed 2. The first predetermined height may be a maximum height of the portion 6*a* of the rim. For example, when the movable frame member 114 is in the first position, as depicted in FIG. 3*a*, the height of the portion 6*a* of the rim above the base 4 may be approximately 320 mm, e.g., between 300 mm and 340 mm.

The second predetermined height may be less than the first predetermined height. When the movable frame member 114 is in the second predetermined position, as depicted in FIG. 3*a*, the height of the portion 8*a* of the rim above the base 4 may be less than 320 mm. When the movable frame member 114 is in the second predetermined position, the height of the portion 8*a* of the rim above the base 2 may be greater than or equal to 120 mm. For example, the second height may be approximately 200 mm, e.g., between 180 mm and 220 mm.

The third predetermined height may be less than the second predetermined height. The third predetermined height may be less than 200 mm. For example, the third predetermined height may be approximately 120 mm.

Figure 4A:
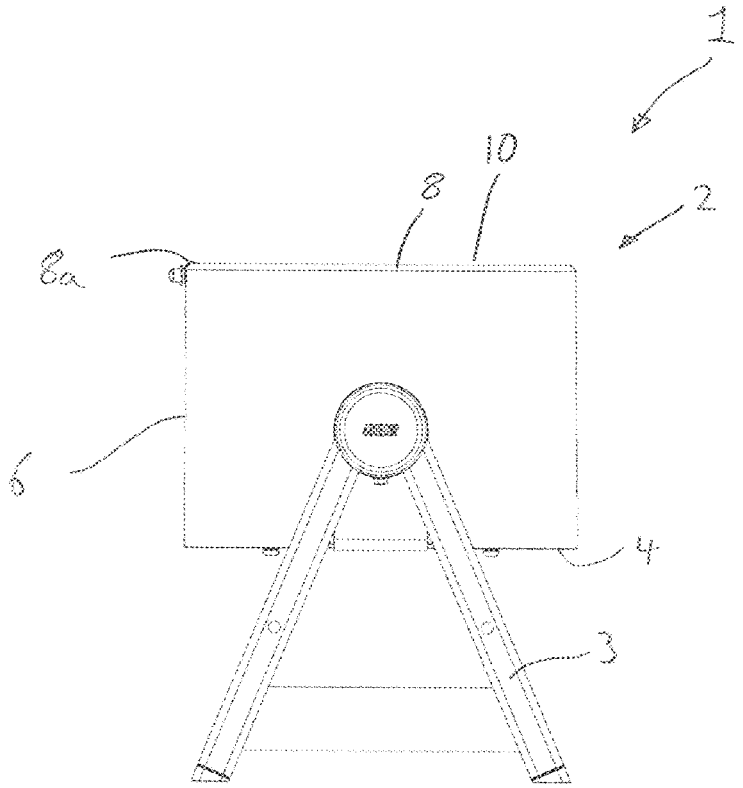
FIGS. 4*a*, 4*b*, and 4*c* are side views of the bed shown in FIG. 1, with the movable frame member of the upper frame of the bed in the first, second, and third predetermined positions, respectively.
Figure 4B:
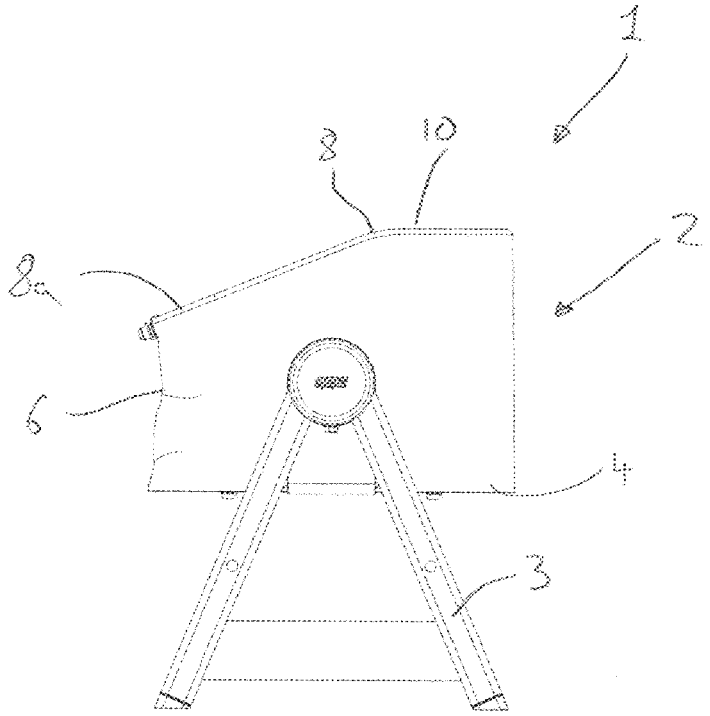
Figure 4C:
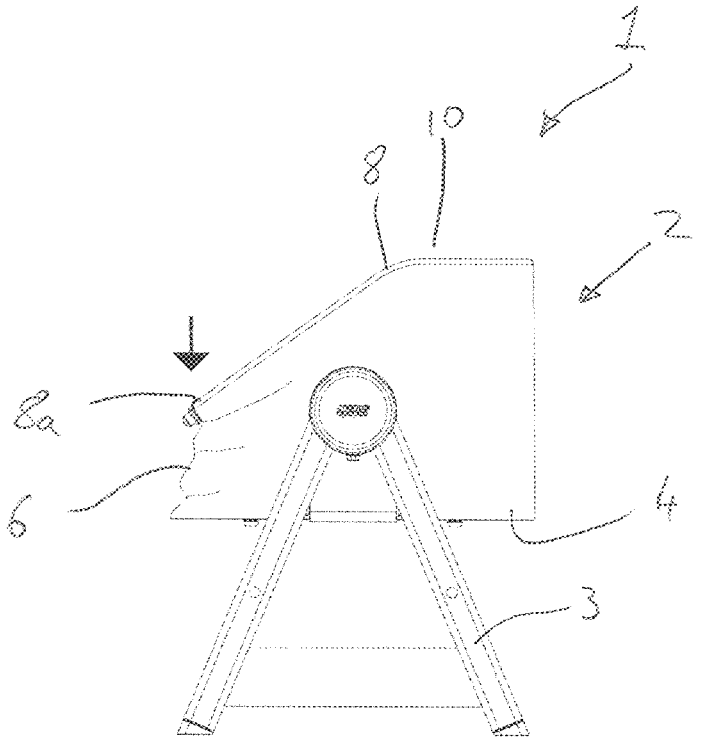

As shown in FIGS. 4*a*, 4*b*, and 4*c*, due to the flexible nature of the material forming the walls 6, when the movable frame member 114 is moved such that the height of the portion 8*a* of the rim is reduced from the maximum height, the wall 6 extending between the base 4 and the portion 8*a* of the rim may partially collapse such that the height of the wall 6 at the portion 8*a* of the rim is reduced by a corresponding amount. A child may thereby be more easily be moved into or out of the bed 2 when the movable frame member 114 is in the second or third predetermined positions, compared to when the movable frame member 114 is in the first predetermined position.

The upper frame 110 further includes a locking mechanism 200 for selectively locking the position of the movable frame member 114 relative to the fixed frame member 112. In the arrangements described herein, the locking mechanism 200 is configured to selectively lock the position of the movable frame member 114 in the first and second predetermined positions, e.g., such that the movable frame member 114 cannot be moved in the first and/or second directions from the second predetermined position. The locking mechanism 200 may be configured such that the position of the movable frame member 114 cannot be locked in the third predetermined position.

Figure 5:
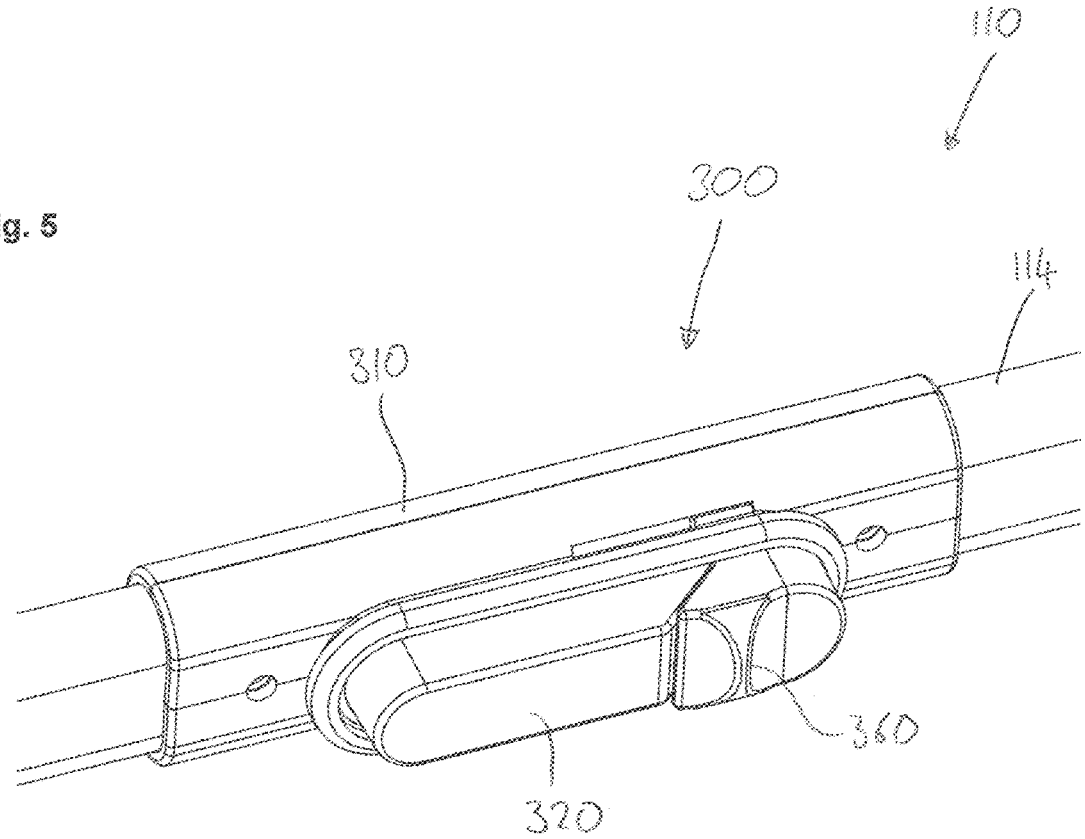
FIG. 5 is a perspective view of an actuator assembly of the upper frame of the bed shown in FIG. 1.

With reference to FIG. 5, the upper frame 110 may further include an actuator assembly 300 for actuating the locking mechanism 200, as disclosed herein, to selectively lock and unlock the locking mechanism 200.

Figure 6A:
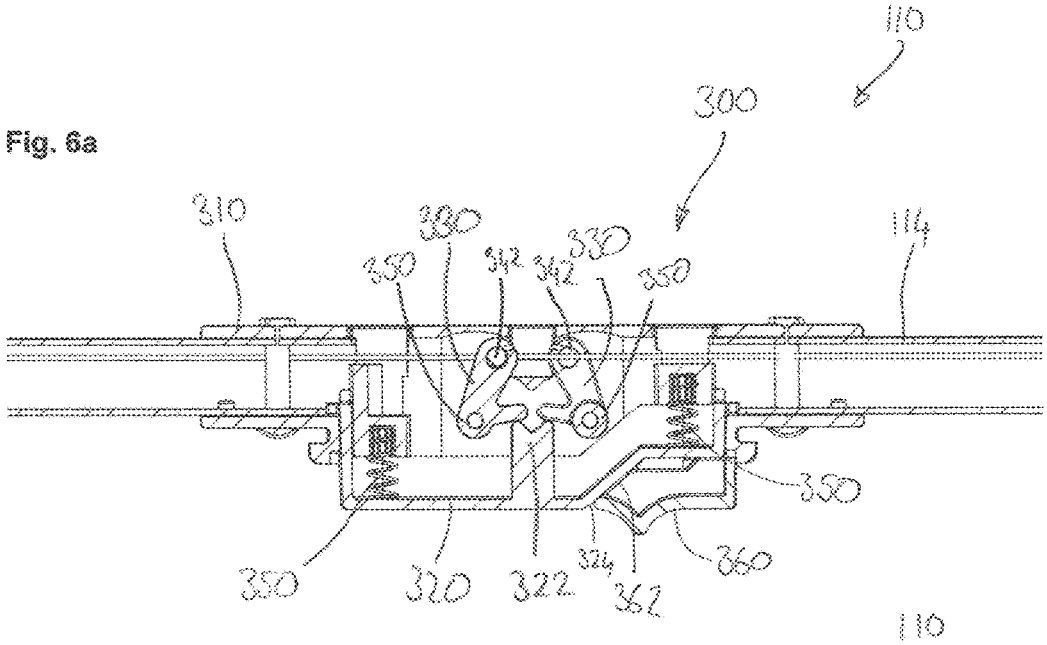
FIGS. 6*a*, 6*b*, and 6*c* are cross-sectional views of the actuator assembly shown in FIG. 4 in first, second, and third configurations, respectively.
Figure 6B:
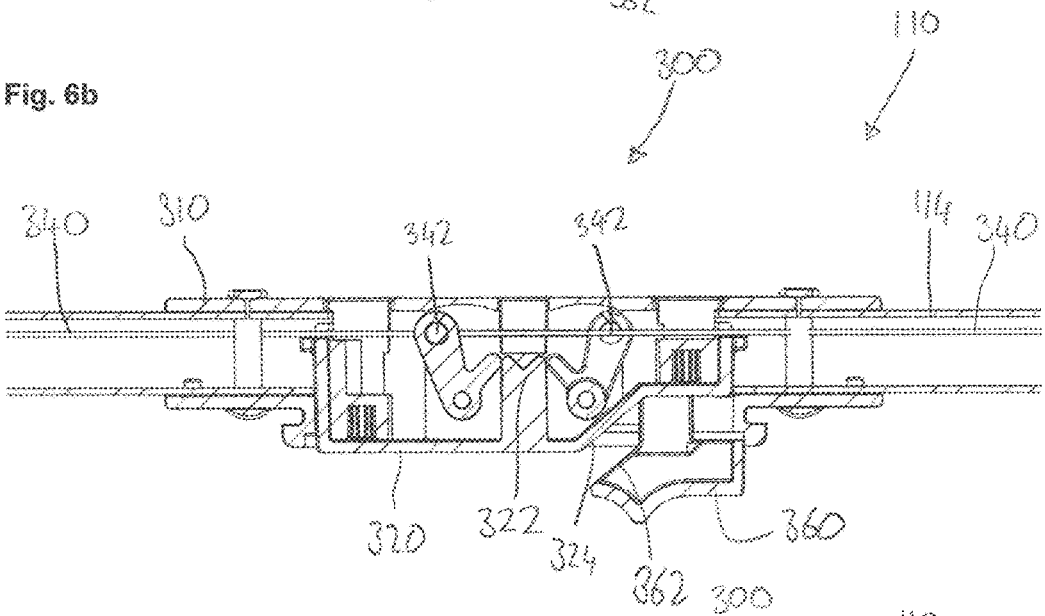
Figure 6C:
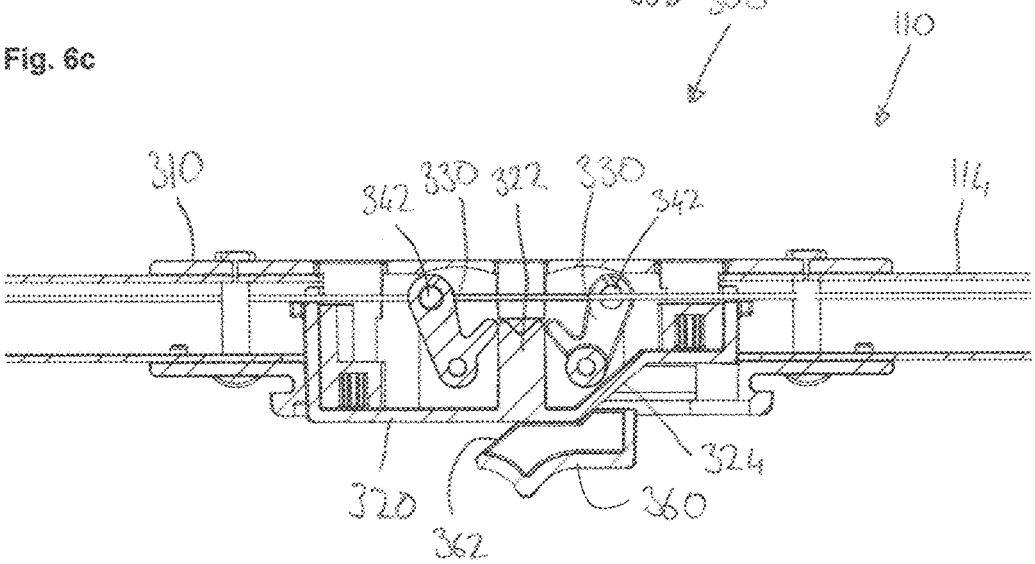

With reference to FIGS. 6*a*, 6*b*, and 6*c* the actuator assembly 300 may include an actuator housing 310 and an actuator 320, such as a button, movably, e.g., slidably, mounted on the actuator housing 310. In particular, the actuator 320 may be movable between a non-actuated position, depicted in FIG. 6*a*, and an actuated position, depicted in FIGS. 6*b* and 6*c*.

The actuator assembly 300 may further include one or more levers 330 pivotally mounted on the actuator housing. The actuator 320 may include an actuating portion 322 and, as depicted in FIG. 6*b*, the actuator assembly may be configured such that moving the actuator 320 relative to the actuator housing 310, e.g., depressing the actuator button, causes the actuating portion 322 of the actuator to act against the levers 330 to pivot the levers 330 relative to the actuator housing 310.

One or more linkages 340, such as pull cables, may be coupled to the levers 330. In particular, first ends 342 of the linkages may be coupled to the levers 330. Pivoting of the levers 330, e.g., due to the action of the actuator 320, may act to move, e.g., push or pull on the linkages 340. The linkages 340 may be coupled to locking mechanism 200 and optionally the further locking mechanism, as described below, and moving the linages 340 may thereby control the operation of the locking mechanism 200 and optionally the further locking mechanism.

In the arrangements shown, one of the linkages 340 extends from a lever 330 of the actuator assembly to the locking mechanism 200, and another of the linkages 340 extends from another lever 330 of the actuator assembly to the further locking mechanism 200*a*. However, in other arrangements, e.g., in which the further locking mechanism 200*a* is omitted, a single linkage 340 or single lever 330 may be provided.

In other arrangements, the actuator assembly 300 may include any other mechanism for converting movement of the actuator 320 to movement of the linkages 340.

The actuator assembly 300 may further include one or more biasing members 350, e.g., resilient elements, such as coil springs, configured to bias the actuator into the non-actuated position. In some arrangements, one or more further biasing members 350 may be provided for biasing the levers 330 into non-actuated positions of the levers 330.

The actuator assembly 300 may further include a further actuator 360 movably, e.g., slidably, mounted on the actuator housing 310. As depicted, the further actuator 360 may be movable in a direction perpendicular to the direction in which the actuator 320 moves. The further actuator 360 may be movable between a first position, depicted in FIGS. 6*a* and 6*b*, in which movement of the actuator 320 is not restricted by the further actuator 360, and a second position, depicted in FIG. 6*c*, in which the further actuator 360 engages the actuator 320 to restrain the actuator 320 in the actuated position.

The further actuator 360 and/or the actuator 320 may include a ramped surface 324, 362 arranged such that movement of the further actuator 360 from the first position toward the second position causes the further actuator to engage the actuator at the ramp surface or surfaces 324, 362 and the actuator is urged to move toward the actuated position due to the engagement of the ramped surface or surfaces 324, 362.

Figure 7:
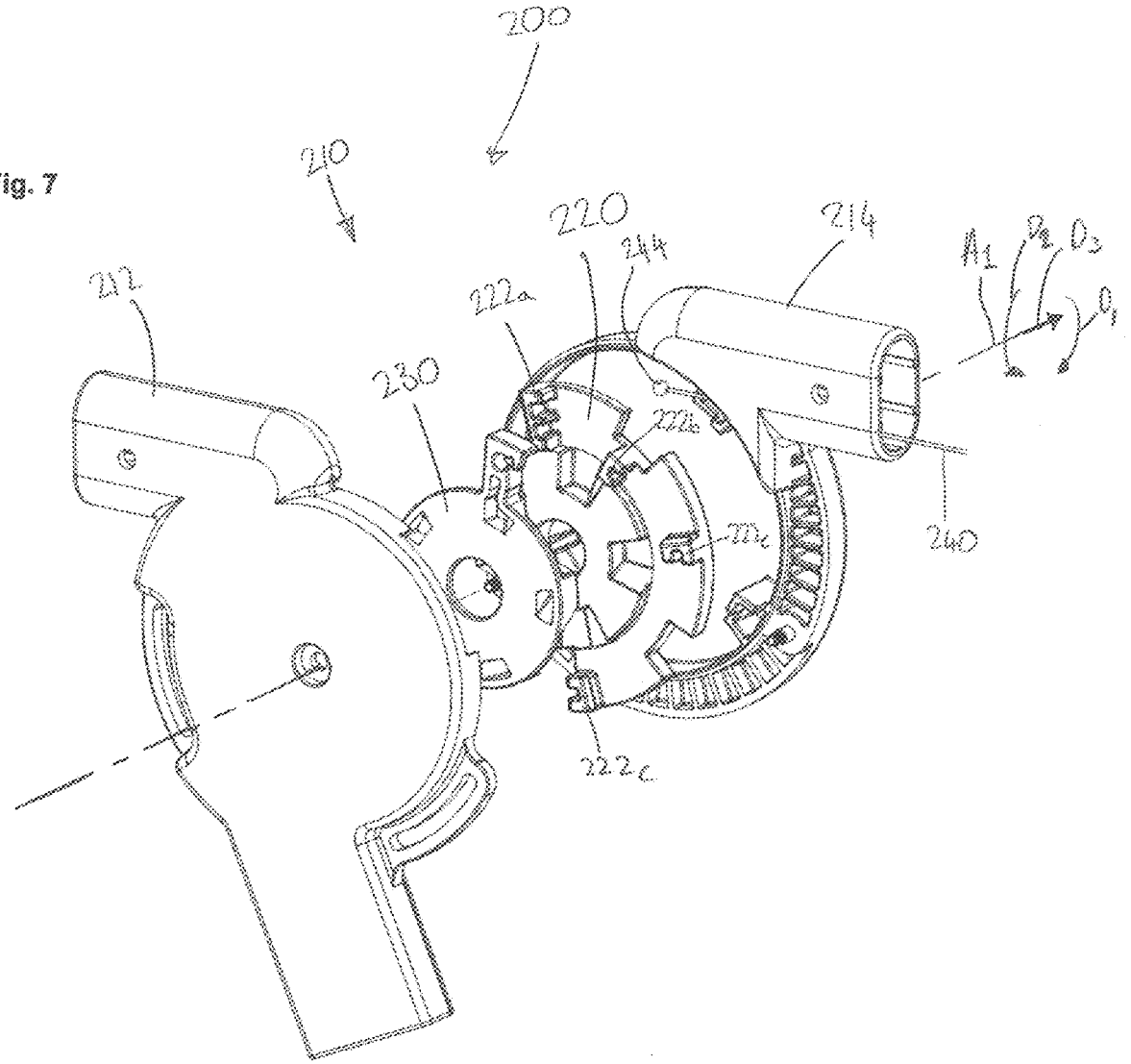
FIG. 7 is an exploded perspective view of a locking mechanism of the bed shown in FIG. 1.
Figure 8:
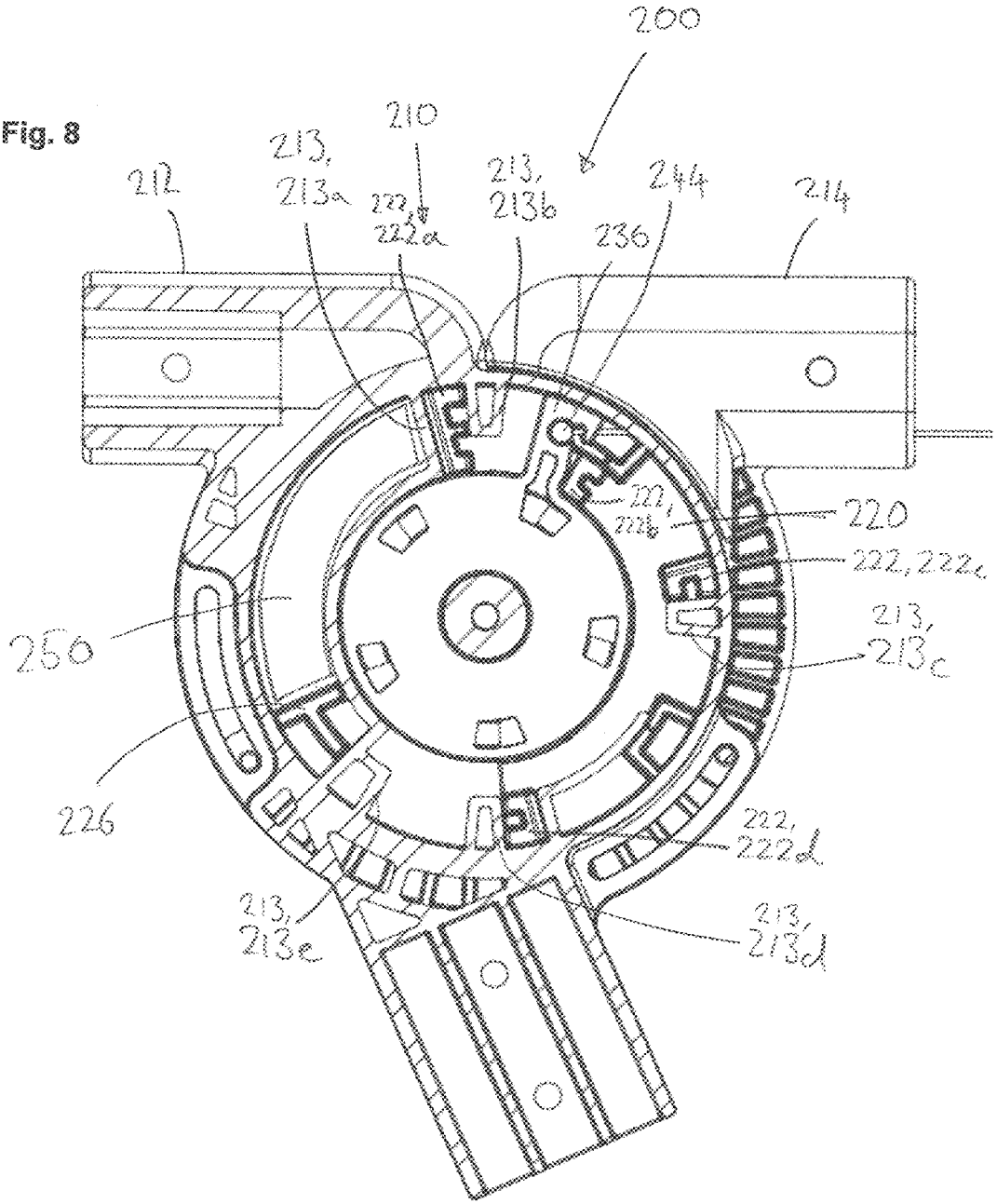
FIG. 8 is a cross-sectional view of the locking mechanism shown in FIG. 7 when the movable frame member of the upper frame is in the first predetermined position.

With reference to FIGS. 7 and 8, the locking mechanism 200 will now be described. As described above, the further locking mechanism 200*a* may be a mirror image of the locking mechanism 200 and the features described in relation to the locking mechanism 200 may apply equally to the further locking mechanism 200*a*.

The locking mechanism 200 may include the hinge assembly 210. The locking assembly may further include a first locking component 220 and a second locking component 230.

The first locking component 220 is coupled to the second hinge component 214 such that the first locking component 220 moves together with the second hinge component 214 when the second hinge component pivots relative to the first hinge component 212, e.g., in the first and second direction $D_1$, $D_2$. In other words, the first locking component 220 is restricted from moving relative to the second hinge component 214 in the first direction. Additionally, the first locking component 220 is coupled to the second hinge component 214 such that the first locking component is movable relative to the second hinge component in the third direction $D_3$. For example, the first locking component 220 may be slidably coupled to the second hinge component 214 such that the first locking component is slidable relative to the second hinge component 214 in the third direction $D_3$. As described above, the third direction may include a component parallel to the first axis $A_1$. The third direction may be perpendicular to the first and second directions.

The first locking component 220 further includes one or more engagement portions 222. For example, as shown in FIG. 8, the first locking component 220 may include first, second, and third engagement portions 222*a*, 222*b*, 222*c*. The first hinge component 212 may include one or more complementary engagement portions 213. For example, as shown in FIG. 8, the first hinge component may include first, second, third, fourth, and fifth complementary engagement portions 213*a*, 213*b*, 213*c*, 213*d*, and 213*e*. The locking mechanism 200 may be configured such that when the locking mechanism is in a locked configuration, one or more of the engagement portions 222 engage one or more of the complementary engagement portions 213 respectively in order to lock the position of the first locking component 220 relative to the first hinge component 212 in the first and/or second directions. As described above, the first locking component 220 is fixed relative to the second hinge component 214 in the first and second directions, and hence, when the locking mechanism is in the locked configuration, the first hinge component may be locked relative to the second hinge component in the first and second directions D1, D2.

The second locking component 230 may be pivotally coupled to the second hinge component 214 such that the second locking component 230 is able to move in the first and second directions $D_1$, $D_2$ relative to the second hinge component. For example, the second locking component 230 may be movable about the first axis $A_1$ in clockwise and anti-clockwise directions relative to the second hinge component. The linkage 340, e.g., the second end 344 of the linkage, may be coupled to the second locking component 230. The actuator assembly 300, the locking mechanism 200, and the linkage 340 may be configured such that moving, e.g., actuating, the actuator assembly 300, e.g., between the actuated and non-actuated positions of the actuator 320, moves the linkage 340 in order to move the second locking component 230 relative to the second hinge component in the first and/or second direction $D_1$, $D_2$.

Figure 9:
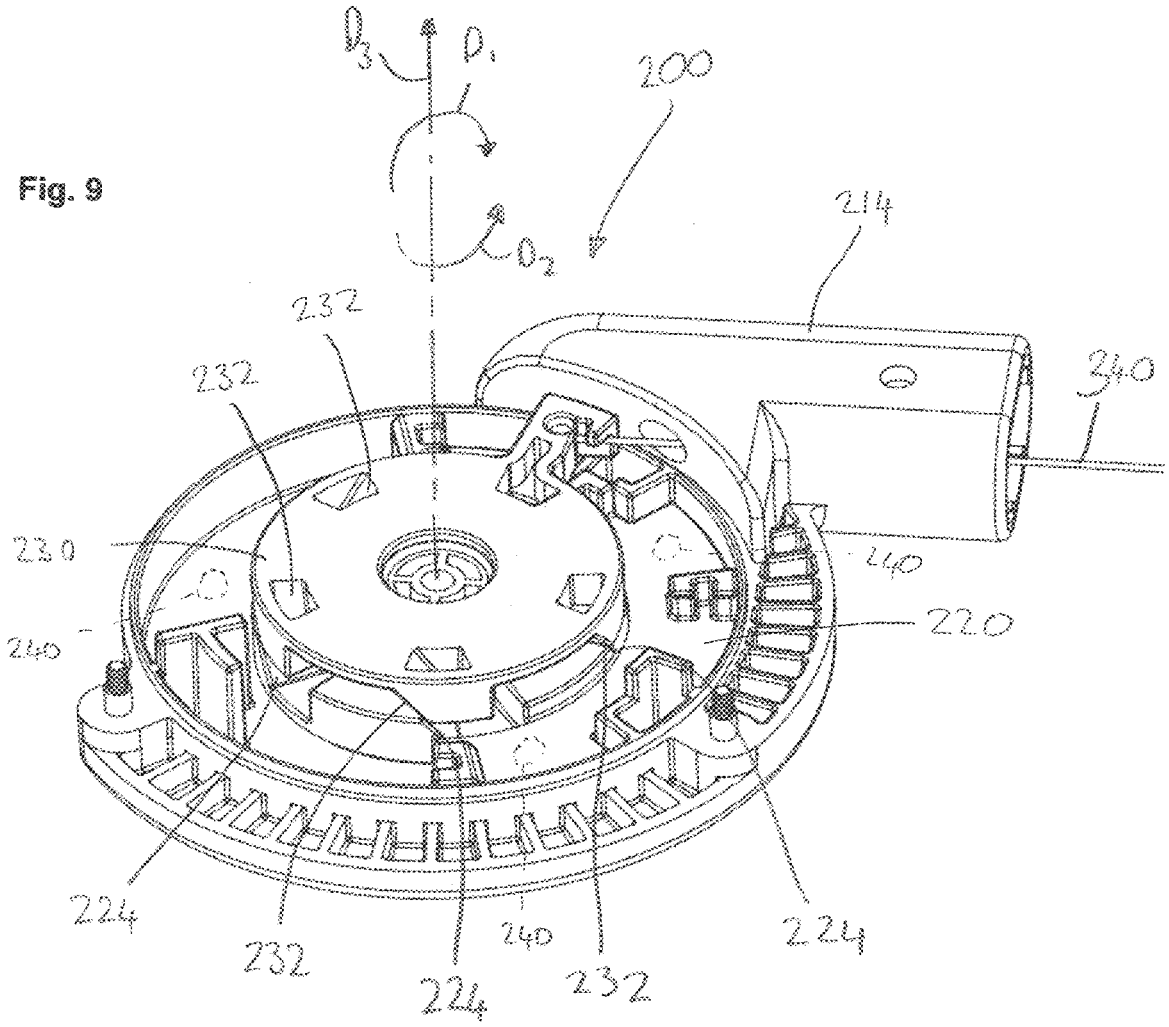
FIG. 9 is a perspective view of the locking mechanism in an unlocked configuration, a fixed hinge component being omitted for clarity.

With reference to FIG. 9, the second locking component 230 and/or the first locking component 220 may include one or more ramp surfaces. For example, in the arrangement shown in FIG. 9, the second locking component 230 includes one or more ramps surfaces 232, and the first locking component 220 includes a corresponding number of complementary ramp surfaces 224. The first and second locking components 220, 230 are arranged such that movement of the second locking component 230, e.g., under the action of the actuator, causes the ramp surface or surfaces to engage. In particular, in the arrangement shown in FIGS. 7 to 9, movement of the second locking component 230 relative to the first locking component 220 in the first direction $D_1$ causes the ramp surfaces 232 of the second locking component 230 to engage and ride over the complementary ramp surfaces 224 on the first locking component 220.

The second locking component 230 may be fixed relative to the first hinge component in the third direction $D_3$. Hence, as shown in FIG. 9, when one of the ramp surfaces 232 of the second locking component 230 engages and ride over one of the complementary ramp surfaces 234 on the first locking component 220, the first locking component 220 may be urged in the third direction $D_3$, e.g., away from the first hinge component. In particular, the first locking component may be moved in the third direction $D_3$ between a locking configuration of the locking assembly, in which the one or more of the engagement portions 222 are at least partially aligned with the or more of the complementary engagement portions 213 in the third direction $D_3$, unlocked configuration, in which one or more of the engagement portions 222 do not align with one or more of the complementary engagement portions 213 in the third direction $D_3$. The locking mechanism may include one or more biasing elements 240 configured to bias the first locking component 220 in the third direction $D_3$ toward a position in which the engagement portions 222 are at least partially aligned with the complementary engagement portions 213 in the third direction $D_3$, e.g., the locked configuration of the locking mechanism.

FIG. 8, illustrates a configuration of the locking mechanism 200 when the position of the movable frame member is in the first predetermined position. As shown in FIG. 8, in this configuration, the first engagement portion 222*a* is arranged to engage the first and second complementary engagement portions 213*a*, 213*b* in order to prevent movement of the first locking component 220 in the first and second directions. Additionally, the second engagement portion 222*b* may be arranged to engage the third complementary engagement portion 212*c* and in order to prevent movement in the first direction. Additionally or alternatively, the third engagement portion 222*c* may be arranged to engage the fourth complementary engagement portion 212*d* in order to prevent movement in the first direction in a clockwise direction.

When the first locking component 220 is urged in the third direction $D_3$, one or more of the engagement portions 222 of the first locking component may become unaligned with one or more of the complementary engagement portions 213 of the first hinge component in the third direction $D_3$. In particular, in the arrangement described herein, the first engagement portion 222*a* may no longer be aligned with the second complementary engagement portion 213*b*, the second engagement portion 222*b* may no longer be aligned with the third complementary engagement portion 212*c* and the third engagement portion 222*c* may no longer be aligned with the fourth complementary engagement portion 212*d*. Consequently, the first locking component 220 may be able to move in the first direction relative to the first hinge component, thereby enabling the second hinge component to move relative to the second hinge component in the first direction.

The first and second locking portions may thereby be configured to selectively permit the first and second hinge components to move relative to one another in the first direction. In particular, the first and second hinge component may be moved relative to one another in order to move the movable frame member between the first, second and third predetermined positions.

Figure 10A:
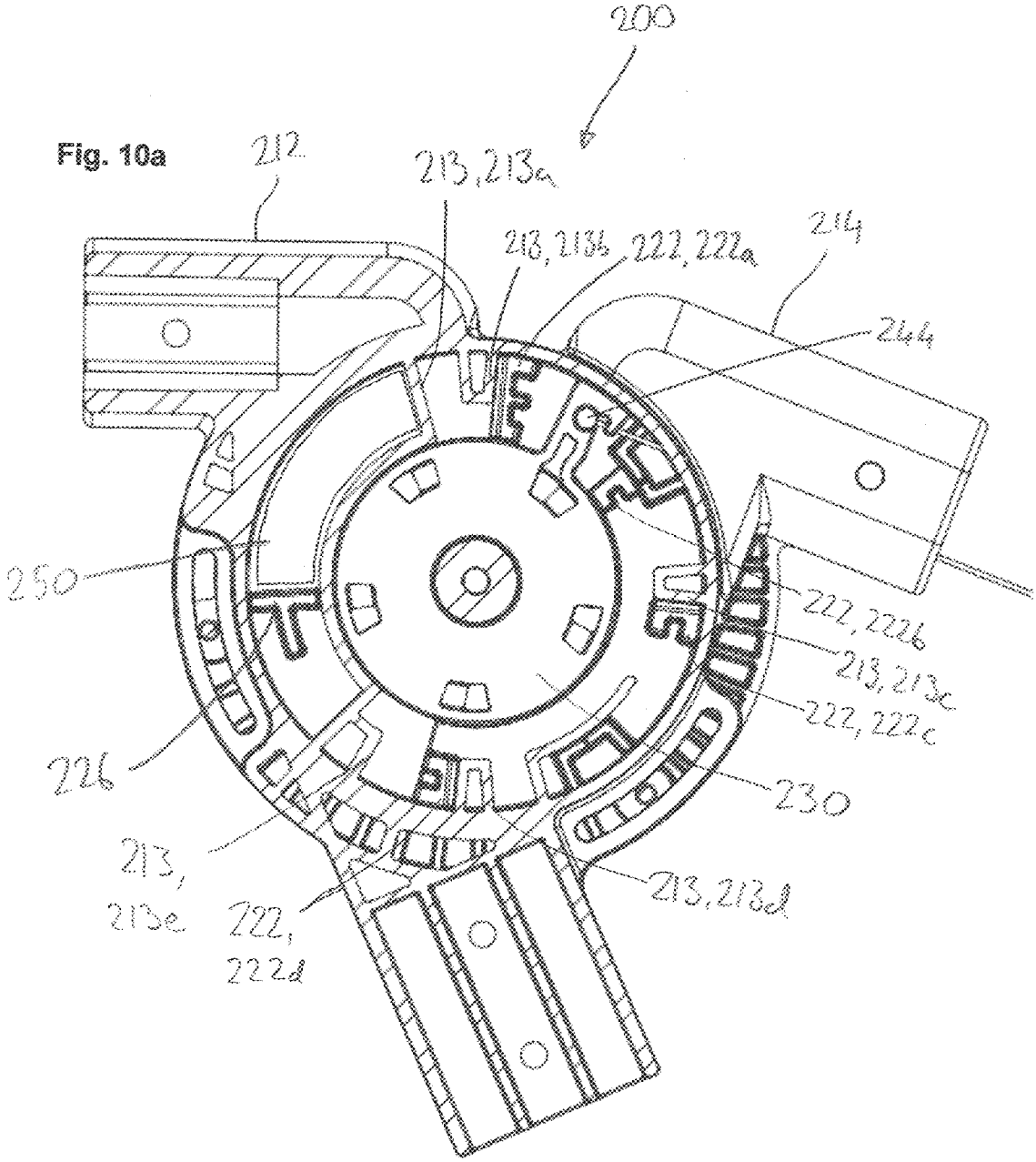
FIGS. 10*a* and 10*b* are cross-sectional views of the locking mechanism shown in FIG. 7 when the movable frame member of the upper frame is in the second and third predetermined positions, respectively.
Figure 10B:
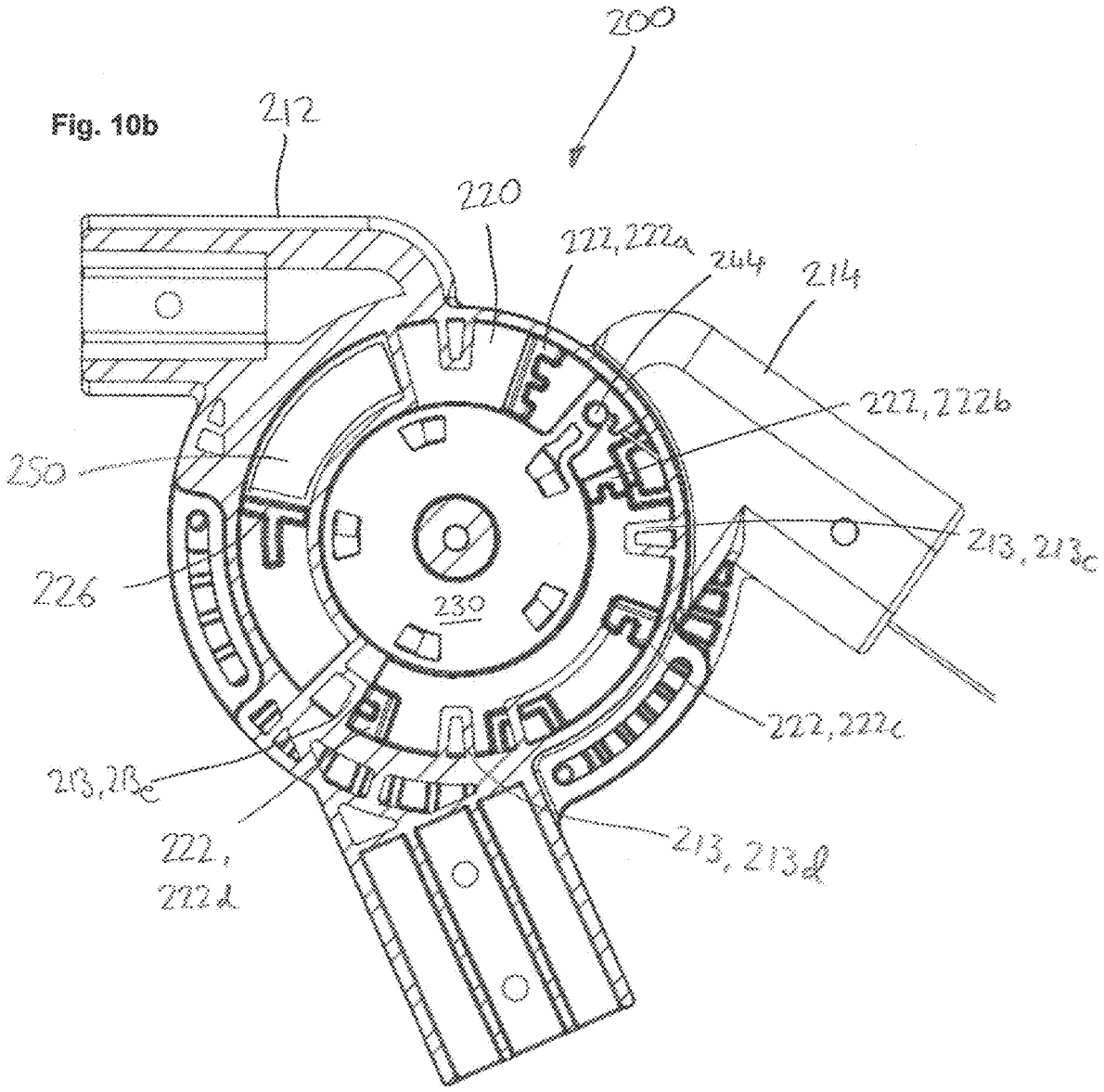

FIGS. 10*a* and 10*b* depict the locking mechanism 200 when the movable frame member 114 is in the second and third predetermined positions respectively. As depicted in FIG. 10*a*, when the movable frame member 114 is in the second predetermined position, the first locking component may be arranged relative to the first hinge component such that the first engagement portion 222*a* can engage the second complementary engagement portion 213*b* of the first hinge component, such that the second locking component is prevented from moving in the second direction, e.g., toward the first predetermined position of the movable frame member, when the locking mechanism is in a locking configuration. Additionally, the second engagement portion 222*b* of the first locking component may be engageable with the third complementary engagement portion 213*c* such that the second locking component can be prevented from moving in the second direction. Additionally or alternatively, the third engagement portion 222*c* of the first locking component may be engaged with the fourth complementary engagement portion 213*d* such that the first locking component is prevented from moving in the second direction.

As shown in FIG. 10*a*, and described above, when the movable frame member 114 is in the second predetermined position, the locking mechanism may be able to prevent the movable frame member 114 from moving toward the first predetermined position, e.g., when the locking mechanism is in the locking configuration. However, the locking mechanism may not be configured to prevent movement of the movable frame member 114 toward the third predetermined position, e.g., when the locking mechanism is in the locking configuration or otherwise. In other arrangements, the locking mechanism may be configured to prevent movement of the movable frame member 114 toward the third predetermined position, e.g., when the locking mechanism is in the locking configuration. For example, one or the complementary engagement portions 213 may be arranged to be engaged one of the engagement portion 222 in order to prevent movement of the first locking component 220 (and hence, the second hinge component 214) in the first direction $D_1$, e.g., when the locking mechanism is in the locking configuration.

As depicted in FIG. 10*b*, when the movable frame member 114 is in the third predetermined position, the first locking component 220 may be arranged relative to the first hinge component 212 such that the fourth engagement portion 222*d* of the first locking component may engage with the fifth complementary engagement portion 213*e* of the first hinge component such that the first locking component can be prevented from moving the first direction $D_1$ relative to the first hinge component. The movable frame member 114 may thereby be prevented from moving such that the height of the portion 8*a* of the rim is reduced to a height less than the third predetermined height.

In the arrangement described herein, the fifth complementary engagement portion 213*e* of the first hinge component 212 has a height in the third direction that is sufficiently large such that the fourth engagement portion 222*d* is at least partially aligned with the fifth complementary engagement portion in the third direction $D_3$ when the locking mechanism 200 is in the locked and unlocked configuration. Hence, the fourth engagement portion 222*d* is not able to move past the fifth complementary engagement portion 213*e* when the locking mechanism is locked or unlocked. In this way, the movable frame member 114 is prevented from moving past the third predetermined position to reduce the height of the portion 8*a* of the rim to a height less than the third predetermined height when the locking mechanism is locked or unlocked.

The locking mechanism may further include a hinge biasing element 250, e.g., a resilient element, such as a coil spring, configured to bias the second hinge component to move in the second direction relative to the first hinge component, e.g., such that the movable frame member moves from the third predetermined position toward the second and first predetermined positions. In other words, the biasing element may be configured to bias the movable frame member to move such that the height of the portion 8*a* of the rim increases. As depicted, the hinge biasing element 250 may be arranged to act between bias element engaging portions 226, 212*a* formed on the first locking component 220 and the first hinge component 212 respectively. In other arrangements, the hinge biasing element 250 may be configured to act between other components of the hinge assembly 210 or locking mechanism 200 that move relative to one another as the movable frame member moves between the first, second, and third predetermined positions.

In some arrangements, the upper frame 110 may include a further locking mechanism 200*a*. For example, the further hinge assembly 210*a* may be provided as part of the further locking mechanism. The further locking mechanism may be similar to the locking mechanism described above. For example, the further locking mechanism may be a mirror image of the locking mechanism. The further locking mechanism may be configured to selectively lock the position of the movable frame member 114 at the second end 114*b* of the movable frame member, e.g., at the foot end of the bed.

The locking mechanism 200 and the actuator assembly 300 described herein may be configured such that the upper frame 110 is able to operating in a first operating mode or a second operating mode. The operating mode may be selected based on the position of the further actuator 360. In particular, when the further actuator 360 is in the first position, the upper frame may be operating in the first operating mode in which the movable frame member may be movable between the first, second, and third predetermined positions, e.g., by moving the actuator to unlock the locking mechanism. When the actuator is released, the locking mechanism may lock e.g., automatically lock, in the first and second predetermined positions, when the movable frame member is positioned at the first and second predetermined positions. When the upper frame is operating in the first mode, releasing the movable frame member when the movable frame member is at the third predetermined position or between the second and third predetermined positions may cause the movable frame member to return to the second predetermined position, e.g., under the action of the hinge biasing element 250, and become locked at the second predetermined position, such that the movable frame member is prevented from returning to the first predetermined position unless the locking mechanism is moved to the unlocked configuration, e.g., by the actuator.

When the further actuator 360 is in the second position, the upper frame 110 may be operating in the second operating mode in which, the further actuator 360 may maintain the actuator 320 in the depressed position, such that the locking mechanism 200 is maintained in the unlocked configuration. Accordingly, when the upper frame 110 is operating in the second mode, the movable frame member may be movable between the first, second and third predetermined positions. Releasing the movable frame member at a position between the first and third predetermined positions may cause the movable frame member to move to the first predetermined position, e.g., under the action of the hinge biasing element 250.

The principle and mode of operation of this invention have been explained and illustrated in its preferred embodiment. However, it must be understood that this invention may be practiced otherwise than as specifically explained and illustrated without departing from its spirit or scope.

What is claimed is:

1. A bed comprising:

a base forming a surface;

an upper frame including two or more frame members at least partially forming a rim around an opening into an interior space of the bed, and walls extending upwardly from the base to the upper frame and around the surface to partially enclose the interior space of the bed; wherein one of the two or more frame members is a movable frame member that is movable relative to another of the two or more frame members in order to adjust a height of a portion of the rim formed by the movable frame member relative to the base, the movable frame member is movable between first, second, and third predetermined positions at which the height of the portion of the rim is at first, second, and third respective predetermined heights relative to the base, the upper frame includes a locking mechanism configured to selectively lock the movable frame member at the first and second predetermined positions, the locking mechanism including:

a hinge assembly including a first hinge component and a second hinge component that are pivotally coupled together to support pivotal movement of the movable frame member and the other frame member relative to one another about a first axis, and a first locking component slidably coupled to the second hinge component such that the first locking component is slidable relative to the second hinge component in a direction with a component parallel to the first axis in order to lock the position of the first locking component relative to the second component, and the position of the movable frame member is biased to move from the third predetermined position toward the first and second predetermined positions.

2. The bed of claim 1, wherein the third predetermined height is less than the first and second predetermined heights.

3. The bed of claim 1, wherein the upper frame is configured such that the movable frame member is biased to move from the third predetermined position past the second predetermined position to the first predetermined position.

4. The bed of claim 1, wherein in a first mode of operation of the upper frame, the locking mechanism is configured to lock the position of the movable frame member at the second predetermined position when the movable frame member is at the second predetermined position.

5. The bed of claim 4, wherein in the first mode of operation, the locking mechanism is configured to lock the position of the movable frame member at the first predetermined position when the movable frame member is at the first predetermined position.

6. The bed of claim 4, wherein in a second mode of operation of the upper frame, the locking mechanism is configured such that the movable frame member does not become locked in the first or second predetermined positions.

7. The bed of claim 1, wherein the movable frame member forms a portion of the rim extending between a head end of the bed and a foot end of the bed.

8. The bed of claim 1, wherein the upper frame includes an actuator for selectively actuating the locking mechanism between a locking configuration, in which the locking mechanism is configured to lock the position of the movable frame member at the first or second predetermined positions, and an unlocked configuration, in which the movable frame member does not become locked in the first or second predetermined positions.

9. The bed of claim 8, wherein the locking mechanism and/or the actuator is biased into the locking configuration.

10. The bed of claim 8, wherein the upper frame further includes a further actuator configured to selectively lock the actuator in the unlocked configuration.

11. The bed of claim 1, wherein the locking mechanism includes a fixed portion coupled to a component of the upper frame other than the movable frame member and a locking portion, wherein:

the locking portion is configured to move together with the movable component in a first direction as the movable portion moves between the first, second, and third predetermined positions, and the locking portion is movable in a further direction between a locking configuration, in which the locking portion engages the fixed portion to prevent the movable member from moving relative to the other members of the upper frame, and an unlocked configuration, in which the locking portion does not engage the fixed portion.

12. The bed of claim 11, wherein the locking mechanism further includes a further locking portion, wherein:

at least one of the locking portion and the further locking portion includes a ramp surface, and an actuator is configured to selectively move the further locking portion relative to the locking portion between a locking position and an unlocking position of the further locking portion such that the further locking portion and the locking portion engage at the ramp surface, and the locking portion is urged in the further direction.

13. The bed of claim 12, wherein the further locking portion is movable in the first direction.

14. The bed of claim 13, wherein the locking mechanism includes a biasing member configured to bias the locking portion and/or the further locking portion such that the locking portion is moved toward the locking position of the locking portion.

15. The bed of claim 8, wherein the actuator is mounted on the movable frame member.

16. The bed of claim 8, wherein the upper frame includes a linkage extending between the actuator and the locking mechanism.

17. The bed of claim 16, wherein the linkage extends inside a hollow interior of the movable frame member between the actuator and the locking mechanism.

18. The bed of claim 1, wherein the movable frame member is pivotally coupled to the other of the first and second frame members, wherein the movable frame member is movable between the first, second, and third positions by pivoting the movable frame member relative to the other of the first and second frame members.

19. The bed of claim 18, wherein the locking mechanism forms a hinge between the movable frame member and the other of the first and second frame members.

20. The bed of claim 18, wherein the first hinge member is coupled to the other of the first and second frame members, and the second hinge member is coupled to the movable frame member.

21. The bed of claim 11, wherein the first hinge member is coupled to the other of the first and second frame members, and the second hinge member coupled to the movable frame member, and the first hinge member includes the fixed portion.

22. The bed of claim 21, wherein the locking portion is movably coupled to the second hinge member.

23. The bed of claim 12, wherein the first hinge member is coupled to the other of the first and second frame members, and the second hinge member is coupled to the movable frame member, and the further locking portion is movably coupled to the second hinge member.

* * * * *